United States Patent [19]

Ferrari

[11] Patent Number: 4,896,972

[45] Date of Patent: Jan. 30, 1990

[54] DELIVERY LANCE FOR THE HOMOGENEOUS MIXING OF WATER-SOLUBLE PRODUCTS SUCH AS AUTOMOBILE WAXES

[75] Inventor: Loris Ferrari, Carpi, Italy

[73] Assignee: G.L.-S.r.l., Corregio Emilia, Italy

[21] Appl. No.: 179,436

[22] Filed: Apr. 8, 1988

[30] Foreign Application Priority Data

Apr. 30, 1987 [IT] Italy ..... 46839A/87

[51] Int. Cl.[4] ..... B01F 5/00; B05B 1/34; B05B 7/10

[52] U.S. Cl. ..... 366/340; 239/315; 239/488; 239/590.3; 239/590.5

[58] Field of Search ..... 239/310, 315, 590, 590.5, 239/458, 489, 486, 590.3; 366/349, 336, 150, 165, 176, 340; 222/190; 422/263, 275, 276, 289

[56] References Cited

U.S. PATENT DOCUMENTS

| | | | |
|---|---|---|---|
| 860,259 | 7/1907 | Smith | 239/488 |
| 1,625,635 | 4/1927 | Willners | 239/486 |
| 1,936,275 | 11/1933 | Siebert | 239/315 |
| 2,218,790 | 10/1940 | Gifford | 239/310 |
| 2,220,227 | 11/1940 | Gifford | 239/315 |
| 2,537,790 | 1/1951 | Sage | 239/315 |
| 2,747,844 | 5/1956 | Slayter | 366/336 |
| 3,088,634 | 5/1963 | Rosekrans et al. | 239/315 |
| 3,504,893 | 4/1970 | Susuki et al. | 239/488 |
| 4,043,539 | 8/1977 | Gilmer et al. | 366/340 |
| 4,211,368 | 7/1980 | Legros et al. | 239/315 |
| 4,386,855 | 6/1983 | Neal, Jr. et al. | 366/340 |

FOREIGN PATENT DOCUMENTS

| | | | |
|---|---|---|---|
| 45616 | 1/1911 | Austria | 239/488 |
| 217021 | 12/1909 | Fed. Rep. of Germany | 239/590.5 |
| 766558 | 1/1957 | United Kingdom | 239/486 |

*Primary Examiner*—Harvey C. Hornsby
*Assistant Examiner*—Joseph S. Machuga
*Attorney, Agent, or Firm*—Bucknam and Archer

[57] ABSTRACT

A delivery lance for the homogeneous mixing of water-soluble products comprises two coaxial hollow cylindrical members (1), (3) inserted one in the other, the first one (1) being provided with an axial chamber (13) for receiving a mass (66) of soluble product, and the second one (3) defining a surrounding annular chamber (4, 5) which communicates with said chamber (13) through transverse apertures (15) provided in said first member (1). The chamber (13) is provided with an end inlet mouth (10) for the water, which enters the annular chamber (4, 5) with turbulent motion, to then flow towards a discharge mouth (32) remote from the inlet mouth (10). To increase the water turbulence, a perforated jacket (20, 21) can be disposed about the first member (1) to divide the annular chamber into two concentric interspaces (4), (5).

5 Claims, 2 Drawing Sheets

3
31
32
33
30
2
21
22
24
20
23
6
16
15
17
18
19
14
66
12
1
13
11
10

DELIVERY LANCE FOR THE HOMOGENEOUS MIXING OF WATER-SOLUBLE PRODUCTS SUCH AS AUTOMOBILE WAXES

SUMMARY OF THE INVENTION

This invention relates to a delivery lance for water distribution, which is able to homogeneously mix a soluble product with water passing through the lance.

Water distributor devices holding a soap-shaped or candle-shaped mass of water-soluble product nd suitable for use in various sectors have been known for a considerable time.

The product can for example be a fertilizer, an anti-mildew composition, an anti-algae preparation for boats, a detergent or an automobile wax.

In the known devices, the housing for the water-soluble mass is in the form of a portion of the water passage duct, and more precisely a duct portion aligned or directly communicating with the discharge mouth, so that the water in transit firstly strikes the candle and is then discharged together with that portion of product which has dissolved in it. More specifically, the action which results in the dissolving of the product is performed by the liquid threads which contact the candle, and come together after passing the candle, but only partially mixing with those threads which have not struck the candle. For this reason, when the water stream arrives at the discharge with the dissolved product, this is concentrated in only a part of the stream, the remaining part being practically devoid of it.

Largely, the dissolved product is not homogeneously mixed with the water so that its distribution is non-homogeneous and therefore inconvenient. The results of for example an irregular distribution of fertilizer over a crop or a non-homogeneous distribution of wax over an automobile body are easily realized. The main object of the present invention is to provide a delivery lance able to obviate the aforesaid drawbacks while being of simple and rational design.

This object is attained according to the invention by providing a chamber for containing a mass of water-soluble product and an annular chamber surrounding the containing chamber, with which it communicates through a plurality of apertures provided in the wall of the containing chamber.

According to the invention, the containing chamber and annular chamber are defined by two hollow cylindrical members inserted one into the other, the inner one of which is provided with a perforated wall and with an end inlet mouth for the water, whereas the outer one comprises a discharge mouth aligned with the inlet mouth.

By virtue of the aforesaid means, the traversing water is compelled to follow a tortuous path and is thus subjected to a turbulent motion which ensures homogeneous mixing of the dissolved product portion with the water before the water reaches the discharge mouth.

In this respect, the water enters the containing chamber axially to dissolve the soluble product and then leaves this latter radially to reach the annular chamber, from which it is directed axially towards the discharge mouth.

In this manner, the homogeneous mixing of the soluble product with the water is attained.

Furthermore, according to an advantageous characteristic of the invention, the two hollow cylindrical members are removably fixed together, and an outer slidable perforated jacket is associated with the inner hollow member. As will be apparent hereinafter, this latter further improves the mixing, and also enables solid product to be introduced into the chamber and to be retained therein during passage of the water.

The characteristics and constructional merits of the invention will be more apparent from the detailed description given hereinafter with reference to the accompanying figures which illustrate a particular preferred embodiment thereof by way of non-limiting example.

Figure 1:
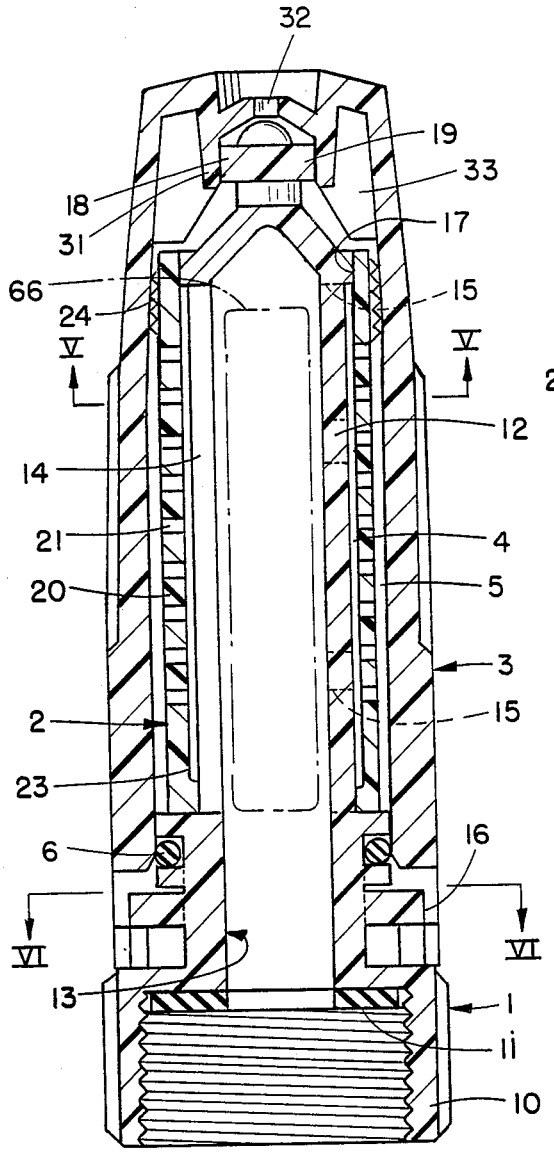
FIG. 1 is a longitudinal section through the device of the invention.

These figures, and in particular FIG. 1, show three substantially cylindrical hollow members indicated by 1, 2 and 3 respectively, which are inserted coaxially one intio the other and are fixed together as described hereinafter.

The three hollow members 1, 2 and 3 are constructed of a convenient synthetic material, but it is apparent that they can be constructed of other suitable materials.

Between the inner member 1 and the intermediate member 2 there is defined a first interspace 4 (see FIGS. 1 and 5), and between the intermediate member 2 and the outer member 3 there is defined a second interspace 5. These two concentric interspaces 4, 5 communicate with each other (see FIG. 5) and connect together the water inlet and discharge mouths in the manner described hereinafter.

Figures 2, 3, 4:
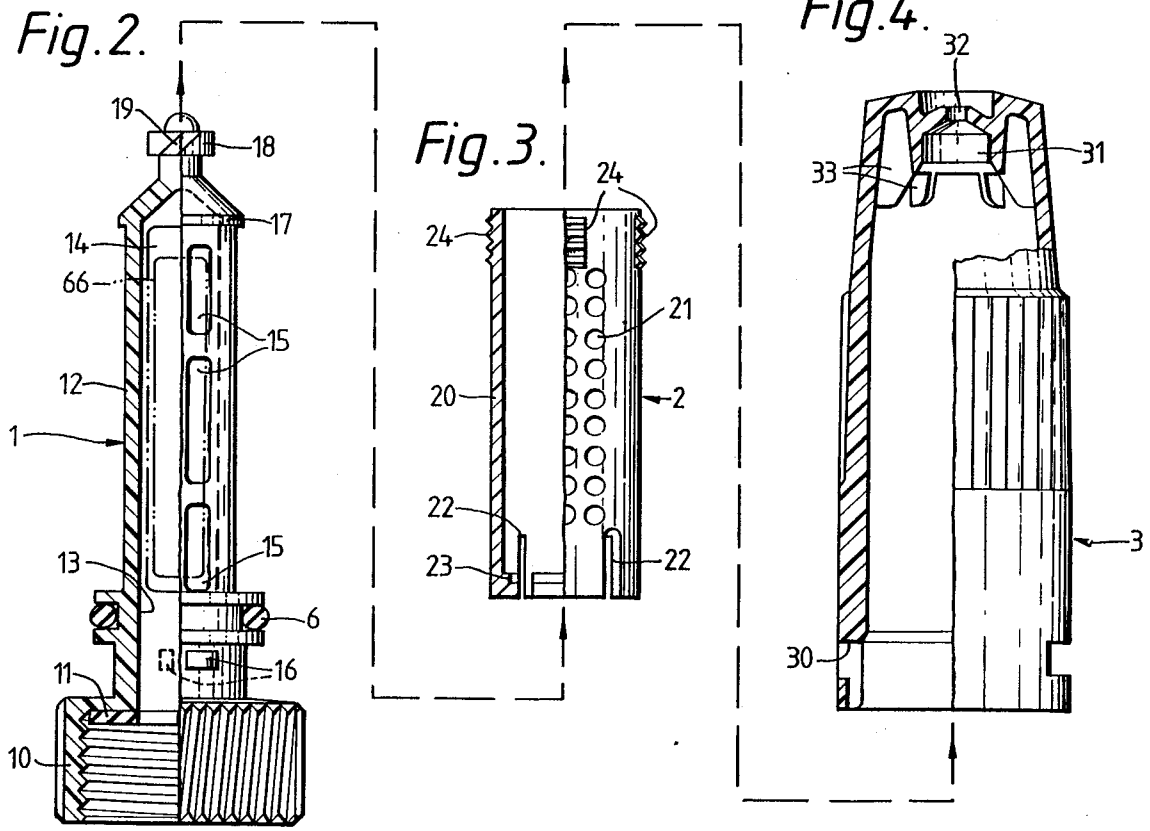
FIG. 2 is a partly sectional side view of the inner hollow cylindrical member.
FIG. 3 is a partly sectional side view of the perforated jacket associated with the inner hollow cylindrical member.
FIG. 4 is a partly sectional side view of the outer hollow cylindrical member.

As best seen in FIG. 2, the inner hollow cylindrical member 1 comprises an internally threaded end coupling 10 provided with a seal gasket 11 and intended to be connected to a water feed pipe, not shown for clarity. From the coupling 10 there branches a tubular element 12, the inner cavity 13 of which forms the chamber for housing a candle 66 (see FIG. 2) of water-soluble product. According to the invention, the candle 66 is inserted through a longitudinal aperture 14 formed in the tubular element 12. From FIG. 1 it can be seen that the aperture 14 can be exposed by withdrawing the outer hollow member 3 and then sliding the intermediate hollow member 2 in a downstream direction. It is apparent that the aperture 14 can also be dispensed with and the candle 66 inserted through the coupling 10 after disconnecting the feed pipe. In this case the intermediate member 2 can also be dispensed with and the tubular element 12 can be densely perforated. The important consideration is that the chamber 13 must be connected to an annular surrounding chamber defined between the two members 1 and 3.

Figure 5:
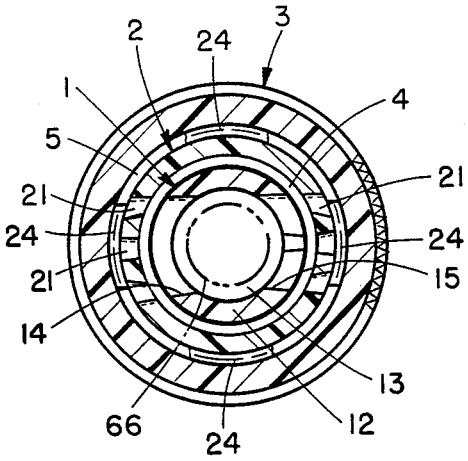
FIGS. 5 and 6 are sections on the lines V—V and VI—VI of FIG. 1 respectively.
Figure 6:
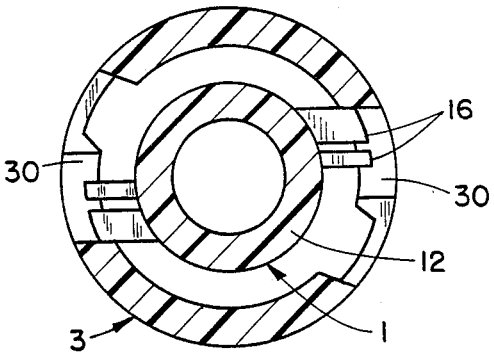

As is clear from FIGS. 1, 2 and 5, the wall of the tubular element 12 comprises along the portion containing the aperture 14 a plurality of narrow longitudinal slots 15 for passage of water with part of the product 66 dissolved in it. As can also be seen from FIG. 6, immediately downstream of the coupling 10 the tubular element 12 comprises two diametrically opposing outer pairs of side-by-side lugs 16, which are elastically deformable in a transverse direction. At the lower end of the outer hollow member 3 (see FIGS. 4 and 6) there—are two circumferential slots 30 which form a bayonet-type connection with the lugs.

The seal between the outer hollow member 3 and the inner hollow member 1 is formed by a gasket 6 disposed on the tubular element 12 (see FIGS. 1 and 2) and lying between said apertures 14, 15 and said lugs 16. Finally, the upper end of the tubular element 12 is closed and comprises a widened shoulder 17 to act as an anti-withdrawal member for the intermediate hollow member 2. The closed end terminates in an atomising head 18 provided with oblique outer grooves 10 and arranged to fit into a cup-shaped portion 31 provided on the upper end of the outer hollow member 3 (see FIG. 4).

The cup-shaped portion 31 is connected to the wall of the member 3 by a series of profiled fins 33 which, in combination with the fact that the cup-shaped portion 31 is disposed in a position rearwards from the downstream end of said outer member 3 means that at least part of the arriving liquid is temporarily directed upstream before discharge. In this manner turbulent motion is generated which favours complete and homogeneous mixing of the dissolved part of the product 66 contained in the water in transit.

As is clear from FIG. 3, the intermediate hollow member 2 consists of a cylindrical jacket 20 provided with a plurality of small through holes 21. In the illustrated case these holes are disposed in two diametrically opposite longitudinal rows, but it is apparent that the number and distribution of the holes 21 can vary. The important consideration is that the jacket 20 must comprise transverse passages able to connect together the two interspaces 4 and 5 (see FIGS. 1 and 5) which connect 13 to 32 (see FIG. 1). As is best seen in FIG. 5, the small holes 21 are flared, with some being oriented in a radial direction and others being oriented along directions defined by chords. The purpose of this is to subject the traversing water to turbulent motion facilitating the complete mixing of that part of the product 66 contained in the transporting water.

In addition, the jacket 20 has an inner diameter such as to be able to be mounted practically as a tight fit (see FIG. 1) over the shoulder 17 of the inner hollow member 1.

The upstream end of the jacket 20 is made elastic by a series of longitudinal cuts 22, and inside the upstream end there are provided projections 23 to rest against the shoulder 17 (see FIG. 1) when the jacket 20 is withdrawn from 12 during insertion of a candle 66 into 13.

It is apparent that the cuts 22 also form communication ports between 4 and 5, and in addition on the upper end of the jacket 20 there is provided an external circumferential series of equidistant groups of transverse ribs 24 (see FIG. 3). The purpose of the latter, which are of right triangular section, is to further disturb the regular flow of the liquid threads, for the same reason.

The use, operation and advantages of the invention are apparent from the aforegoing description and from an examination of the accompanying figures.

It should be noted that from tests carried out it has been found that the invention provides at its discharge a stream of water in which that part of the product removed from 66 is uniformly distributed.

The invention is not limited to the embodiment illustrated and described, but also comprises all technical equivalents of the aforesaid means and their combinations, provided they are implemented in accordance with the following claims.

What is claimed is:

1. A delivery lance apparatus for the homogeneous mixing of a water-soluble material with water which comprises a first and second hollow cylindrical members (1), (3) having upper and lower end, said first hollow cylindrical member (1) having transverse slots therein and an inlet (10) for the water at its said lower end, said second hollow cylindrical member (3) being provided with an outlet (32) for the water, said first hollow cylindrical member (1) being inserted into said second hollow cylindrical member (3) to define a first annular chamber (4) surrounding the inner member (1), sealing means (6) between said first and second hollow cylindrical member, said first hollow cylindrical member (1) having a second innermost coaxial chamber (13) for containing a mass (66) of said soluble material and communicating with said first annular chamber (4) through said transverse slots (15); said second hollow cylindrical member (3) having an inwardly projecting cup-shaped element (31) at its said upper end, said cup-shaped element has a base, said discharge outlet mouth (32) being located in the base of said cup-shaped element, whereby water introduced through said inlet (10) follows a tortious path, homogeneous mixing of water occurs with said water-soluble material placed in said second coaxial chamber (13), and wherein said first hollow cylindrical member (1) is provided with an atomizing head (18) at its said upper end, said atomizing head has oblique grooves (19) and said atomizing head is located in said cup-shaped element.

2. A delivery lance apparatus for the homogeneous mixing of a water-soluble material with water which comprises a first and second hollow cylindrical members (1), (3) having upper and lower end said first hollow cylindrical member (1) having transverse slots therein and an inlet (10) for the water at its said lower end, said second hollow cylindrical member (3) being provided with an outlet (32) for the water, said first hollow cylindrical member (1) being inserted into said second hollow cylindrical member (3) to define a first annular chamber (4) surrounding the inner member (1), sealing means (6) between said first and second hollow cylindrical member, said first hollow cylindrical member (1) having a second innermost coaxial chamber (13) for containing a mass (66) of said soluble material and communicating with said first annular chamber (4) through said transverse slots (15); said second hollow cylindrical member (3) having an inwardly projecting cup-shaped element (31) at its said upper end, said cup-shaped element has a base, said discharge outlet mouth (32) being located in the base of said cup-shaped element, whereby water introduced through said inlet (10) follows a tortious path, homogeneous mixing of water occurs with said water-soluble material placed in said second coaxial chamber (13), and wherein said first and second hollow cylindrical members (1), (3) are removably fixed together, said upper end of said first hollow cylindrical member (1) is provided with a widened shoulder (17) said apparatus further comprising a perforated cylindrical jacket (20) mounted on said widened shoulder (17) and is arranged to divide said first annular chamber (4) into two concentric interspaces (4), (5).

3. The apparatus according to claim 2 wherein said slots (15) provided in said first hollow cylindrical member (1) comprise a longitudinal opening (14) for introduction of said mass (66).

4. The apparatus according to claim 2 wherein said jacket (20) comprises a plurality of flared holes (21), some of said holes are oriented in radial directions and some of said holes are oriented in directions defined by chords.

5. The apparatus according to claim 2 wherein said jacket (20) has a plurality of small transverse ribs (24) on the outer surface thereof.

* * * * *